United States Patent [19]

Kato et al.

[11] Patent Number: 5,055,369

[45] Date of Patent: Oct. 8, 1991

[54] LIQUID DEVELOPER FOR ELECTROSTATIC PHOTOGRAPHY

[75] Inventors: Eiichi Kato; Hiroshi Ishibashi; Kazuo Ishii, all of Shizuoka, Japan

[73] Assignee: Fuji Photo Film Co., Ltd., Kanagawa, Japan

[21] Appl. No.: 325,795

[22] Filed: Mar. 20, 1989

[30] Foreign Application Priority Data

Mar. 18, 1988 [JP] Japan ..... 63-64970

[51] Int. Cl.[5] ..... G03G 9/12

[52] U.S. Cl. ..... 430/114; 430/115

[58] Field of Search ..... 430/114, 115, 137

[56] References Cited

U.S. PATENT DOCUMENTS 4,837,102 6/1989 Dan et al. ..... 430/114
4,840,865 6/1989 Kato ..... 430/114
4,842,975 6/1989 Kato ..... 430/114

FOREIGN PATENT DOCUMENTS 0155788 9/1985 European Pat. Off. .
2186095 8/1987 United Kingdom .

OTHER PUBLICATIONS

Patent Abstracts of Japan, vol. 10, No. 38, Feb. 14, 1986.

*Primary Examiner*—John Goodrow
*Attorney, Agent, or Firm*—Sughrue, Mion, Zinn Macpeak & Seas

[57] ABSTRACT

A liquid developer for electrostatic photography is disclosed. The liquid developer comprises a resin dispersed as grains in a non-aqueous solvent having an electrical resistance of $10^9$ Ωcm or more and a dielectric constant of 3.5 or less, which is characterized in that the dispersed resin grains are copolymer resin grains obtained by polymerizing a solution containing at least one monofunctional monomer (A) which is soluble in the non-aqueous solvent but becomes insoluble therein after polymerization and at least one monofunctional macromonomer (B) which is composed of a polymer moiety having a repeating unit of the following formula (I) and a copolymerizable double bond-containing group of the following formula (II) bonded to only one terminal of the main chain of the polymer moiety and which has a number average molecular weight of $1\times10^4$ or less, in the presence of a resin which is soluble in the non-aqueous solvent and which contains no graft group capable of polymerizing with the monomers;

(I)

(II)

In formula (I), X represents —COO—, —OCO—, —$CH_2$OCO—, —$CH_2$COO—, —O—, —$SO_2$—, $R_1$ represents a hydrogen atom or a hydrocarbon group having from 1 to 18 carbon atoms;

Y represents a hydrocarbon group having from 1 to 22 carbon atoms;

$a_1$ and $a_2$ each represents a hydrocarbon atom, a halogen atom, a cyano group, a hydrocarbon group having from 1 to 8 carbon atoms, a group —COO—Z or a group —COO—Z as interrupted by a hydrocarbon group having from 1 to 8 carbon atoms; and Z represents a hydrocarbon group having from 1 to 18 carbon atoms;

In formula (II), V has the same meaning as X in formula (I); and $b_1$ and $b_2$ each is selected from the same groups as $a_1$ or $a_2$ in formula (I).

The liquid developer has excellent re-dispersibility, storability, image reproducibility, and fixability.

8 Claims, No Drawings

LIQUID DEVELOPER FOR ELECTROSTATIC PHOTOGRAPHY

FIELD OF THE INVENTION

The present invention relates to a liquid developer for electrophotography, which comprises a resin as dispersed in a liquid carrier having an electric resistance of $10^9$ Ωcm or more and a dielectric constant of 3.5 or less, and, in particular, to that which has excellent re-dispersibility, storability, image-reproducibility, and fixability.

BACKGROUND OF THE INVENTION

In general, a liquid developer for electrophotography is prepared by dispersing an organic or inorganic pigment or dye such as carbon black, nigrosine or phthalocyanine blue and a natural or synthetic resin such as an alkyd resin, acrylic resin, rosine or synthetic rubber in a liquid having a high electric insulating property and a low dielectric constant, such as petroleum aliphatic hydrocarbon, and further adding a polarity-controlling agent such as metal soap, lecithin, linseed oil, higher fatty acid or vinyl pyrrolidone-containing polymer to the resulting dispersion. In such a developer, the resin is dispersed in the form of insoluble latex grains having a grain size (diameter) of from several nm to several hundred nm. In a conventional liquid developer, however, the soluble dispersion-stabilizing resin and the polarity-controlling agent are insufficiently bonded to the insoluble latex grains, so that the soluble dispersion-stabilizing resin and the polarity-controlling agent are freely dispersed in the liquid developer with ease. Accordingly, the soluble dispersion-stabilizing resin would be split off from the insoluble latex grains after storage of the liquid developer for a long period of time or after repeated use thereof, so that the grains would thereafter defectively precipitate, coagulate or accumulate, or the polarity would thereby become indistinct. Since the grains once coagulated and accumulated are difficult to re-disperse, the grains would remain to be adhered to everywhere in the developing machine, and, as a result, cause stain of images formed and accident of the developing machine such as clogging of the liquid-feeding pump.

In order to overcome such defect, a means of chemically bonding the soluble dispersion-stabilizing resin and the insoluble latex trains has been disclosed in U.S. Pat. No. 3,990,980. However, the liquid developer disclosed was still insufficient, although the dispersion stability to spontaneous precipitation of the grains could be improved in some degree. When the liquid developer was actually used in a developing apparatus, the toner adhered to the parts of the apparatus solidified to form a film thereon, and the thus solidified toner grains could hardly be redispersed. In addition, the solidified toner grains caused stain of the images duplicated and troubles in the apparatus. Accordingly, the liquid dipersion as disclosed in U.S. Pat. No. 3,990,980 was found to have a defect that the re-dispersion stability was still insufficient for practical use.

In accordance with the method of preparing the resin grains as disclosed in U.S. Pat. No. 3,990,980, there is an extreme limitation on the combination of the dispersing stabilizer to be used and the monomers to be insolubilized, in order to prepare monodispersed grains having a narrow grain size distribution. Mostly, the resin grains prepared by the method would contain a large amount of coarse grains having a broad grain size distribution, or would be polydispersed grains having two or more different mean grain sizes. In accordance with the method, it is difficult to obtain monodispersed grains having a narrow grain size distribution and having a desired mean grain size, and the method often results in large grains having a grain size of 1 μm or more, or extremely fine grains having a grain size of 0.1 μm or less. In addition, the dispersion stabilizer to be used in the method has another problem in that it must be prepared by an extremely complicated process requiring a long reaction time.

In order to overcome the aforesaid defects, a method of forming insoluble dispersion resin grains of a copolymer from a monomer to be insolubilized and a monomer containing a long chain alkyl moiety, so as to improve the dispersibility, re-dispersibility and storage stability of the grains, has been disclosed in JP-A-60-179751 and JP-A-62-151868 (the term "JP-A" as used herein means an "unexamined published Japanese patent application").

On the other hand, a method of printing a large number of prints of 5000 or more prints has recently been developed, using an offset printing master plate by electrophotography. In particular, because of further improvement of the master plate, it has become possible to print 10,000 or more prints of large size of electrophotography. In addition, noticeable progress has been made in shortening the operation time in an electrophotomechanical system, and the step of development-fixation in the system has been conveniently accelerated.

Under such situation, the dispersion resin grains as prepared by the method disclosed in the aforesaid JP-A-60-179751 and JP-A-61-151868 were found still unsatisfactory with respect to the dispersibility and the re-dispersibility when they were applied to rapid development. In addition, when they were applied to a process wherein the fixation time is shortened, or to a process using a master plate of large size (for example A-3 size or more), they were found also unsatisfactory with respect to the printing durability.

Accordingly, a need has existed to overcome the problems of the aforesaid conventional liquid developers.

SUMMARY OF THE INVENTION

One object of the present invention is to provide a liquid developer having excellent dispersion stability, re-dispersibility and fixability, even when the developer is used in an electrophotomechanical system wherein the development fixation step is accelerated and/or a master plate of large size is used.

Another object of the present invention is to provide a liquid developer capable of forming an offset printing plate precursor having excellent ink-receptivity to printing ink and excellent printing durability by electrophotography.

Still another object of the present invention is to provide a liquid developer which is suitable for various electrostatic photographic uses and various transferring uses, in addition to the above-mentioned uses.

A further object of the present invention is to provide a liquid developer which can be used in any and every liquid developer-using system, for example, for ink-jet recording, cathode ray tube recording, or recording by pressure variation or electrostatic variation.

The objects of the present invention have been attained by a liquid developer for electrostatic photography comprising a resin dispersed in a non-aqueous solvent having an electric resistance of $10^9$ Ωcm or more and a dielectric constant of 3.5 or less, which is characterized in that the dispersed resin grains are copolymer resin grains obtained by polymerizing a solution containing at least one monofunctional monomer (A) which is soluble in the non-aqueous solvent but becomes insoluble therein after polymerization and at least one monofunctional macromonomer (B) which is composed of a polymer moiety having a repeating unit of the following formula (I) and a copolymerizable double bond-containing group of the following formula (II) bonded to only one terminal of the main chain of the polymer moiety and which has a number average molecular weight of $1\times10^4$ or less, in the presence of a resin which is soluble in the non-aqueous solvent and which contains no graft group capable of polymerizing with the monomers.

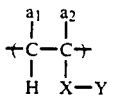

(I)

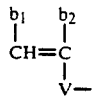

(II)

In the formula (I), X represents —COO—, —OCO—, —$CH_2$OCO—, —$CH_2$COO—, —O—, —$SO_2$—,

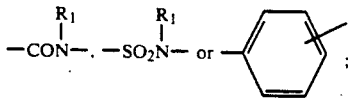

$R_1$ represents a hydrogen atom or a hydrocarbon group having from 1 to 18 carbon atoms;

Y represents a hydrocarbon group having from 1 to 22 carbon atoms;

$a_1$ and $a_2$ (which may be the same or different) each represents a hydrogen atom, a halogen atom, a cyano group, a hydrocarbon group having from 1 to 8 carbon atoms, a group —COO—Z or a group —COO—Z bonded via a hydrocarbon group having from 1 to 8 carbon atoms; and Z represents a hydrocarbon group having from 1 to 18 carbon atoms.

In formula (II), V has the same meaning as X in the formula (I); and $b_1$ and $b_2$ (which may be the same or different) each is selected from the same groups as the above-mentioned $a_1$ or $a_2$.

DETAILED DESCRIPTION OF THE INVENTION

The liquid developer of the present invention is explained in further detail hereunder.

As the liquid carrier for the developer of the invention, which has an electric resistance of $10^9$ Ωcm or more and a dielectric constant of 3.5 or less, straight chain or branched chain aliphatic hydrocarbons and halogen-substituted derivatives thereof can preferably be used. Examples include octane, isooctane, decane, isodecane, decalin, nonane, dodecane, isododecane, Isopar E, Isopar G, Isopar H, Isopar L ("Isopar" is a trademark of Exxon Co.), Shellsol 70, Shellsol 71 ("Shellsol" is a trademark of Shell Oil Co.), Amsco OMS and Amsco 460 solvents ("Amsco" is a trademark of American Mineral Spirits Co.). These may be used singly or in combination.

The non-aqueous dispersion resin grains (hereinafter often referred to as "latex grains") as the most important constituting element of the present invention are prepared by polymerizing the monomer (A) and the macromonomer (B) in the presence of the dispersion-stabilizing resin in a non-aqueous solvent system by a so-called polymerizing granulation method.

As the non-aqueous solvent to be used in the method, any which is miscible with the above-noted liquid carrier for the electrostatic photographic liquid developer of the invention is basically usable in accordance with the present invention.

Specifically, the solvent to be used in preparation of the dispersion resin grains may be any solvent which is miscible with the above-described liquid carrier, and preferably includes straight chain or branched chain aliphatic hydrocarbons, alicyclic hydrocarbons and aromatic hydrocarbons and halogen-substituted derivatives thereof. Examples include hexane, octane, isooctane, decane, isodecane, decalin, nonane, dodecane, isododecane, Isopar E, Isopar G, Isopar H, Isopar L, Shellsol 70, Shellsol 71, Amsco OMS and Amsco 460 solvents. These may be used singly or in combination.

Other solvents which can be used together with the above-mentioned organic solvents in accordance with the present invention include alcohols (e.g., methyl alcohol, ethyl alcohol, propyl alcohol, butyl alcohol, fluorinated alcohol), ketones (e.g., acetone, methyl ethyl ketone, cyclohexanone), carboxylic acid esters (e.g., methyl acetate, ethyl acetate, propyl acetate, butyl acetate, methyl propionate, ethyl propionate), ethers (e.g., diethyl ether, dipropyl ether, tetrahydrofuran, dioxane) and halogenated hydrocarbons (e.g., methylene dichloride, chloroform, carbon tetrachloride, dichloroethane, methyl-chloroform).

The non-aqueous solvents which are used in combination are desired to be evaporated out by heating or distillation under reduced pressure after the polymerizing granulation. However, even though the solvents are incorporated into the liquid developer in the form of a latex grains dispersion, these would cause no problem, provided that the liquid developer could have an electric resistance of $10^9$ Ωcm or more.

In general, it is desired that the same solvent as the liquid carrier is used in the step of forming the resin dispersion. For instance, the solvent may be selected from the above-mentioned straight chain or branched chain aliphatic hydrocarbons, alicyclic hydrocarbons, aromatic hydrocarbons and halogenated hydrocarbons.

The dispersion-stabilizing resin which is necessary so as to make the non-aqueous solvent-insoluble polymer (obtained by polymerization of the above-mentioned monomers) stable in the non-aqueous solvent to give a stable resin dispersion is a resin which contains no graft group capable of polymerizing with the monomers. Any conventional dispersion-stabilizing resin can be used therefor. Specifically, various kinds of synthetic resins or natural resins which are soluble in the non-aqueous solvent may be used singly, or in a combination of two or more kinds thereof. For instance, there may be mentioned polymers of acrylic acid, methacrylic acid or crotonic acid esters having an alkyl or alkenyl chain moiety with a total carbon number of from 6 to 32 (the aliphatic moiety may optionally contain substituent(s) of a halogen atom, a hydroxyl group, an amino group and/or an alkoxy group, or the carbon-carbon bond in the main chain may optionally contain hetero atom(s) of oxygen, sulfur and/or nitrogen), vinyl esters of higher fatty acids having from 6 to 22 carbon atoms, alkylvinyl ethers or olefins such as butadiene, isoprene or diisobutylene, as well as copolymers of two or more of the above-described monomers. In addition, copolymers obtained by copolymerizing one or more of the above-mentioned monomers capable of forming polymers which are soluble in the non-aqueous solvents and one or more of other monomers mentioned below, the amount of the latter monomers being within such a ratio that the copolymers obtainable from the combination of the monomers are soluble in the non-aqueous solvents, can also be used.

Such monomers include, for example, vinyl acetate, allyl acetate; methyl, ethyl or propyl esters of acrylic acid, methacrylic acid, crotonic acid, maleic acid or itaconic acid; styrene derivatives (e.g., styrene, vinyltoluene, α-methylstyrene); unsaturated carboxylic acids such as acrylic acid, methacrylic acid, crotonic acid, maleic acid or itaconic acid, or acid anhydrides thereof; and monomers having various polar groups such as a hydroxyl group, an amino group, an amido group, a cyano group, a sulfonic acid group, a carbonyl group, a halogen atom or a hetero-ring, for example, hydroxyethyl methacrylate, hydroxyethyl acrylate, diethylaminoethyl methacrylate, N-vinylpyrrolidone, acrylamide, acrylonitrile, 2-chloroethyl methacrylate or 2,2,2-trifluoroethyl methacrylate.

In addition to the above-mentioned synthetic resins, other various natural resins such as alkyd resins, alkyd resins modified with various fatty acids, linseed oil or modified polyurethane resins may also be used.

The monomers to be used for preparation of the non-aqueous dispersion resins are composed of two groups of monofunctional monomers (A) which are soluble in the non aqueous solvents but are made insoluble therein by polymerization, and monofunctional macromonomers (B) which are copolymerized with (A).

As the monomers (A), for example, there may be mentioned vinyl esters or allyl esters of aliphatic carboxylic acids having from 1 to 6 carbon atoms (e.g., acetic acid, propionic acid, butyric acid, monochloroacetic acid); alkyl esters or alkyl amides (wherein the alkyl moiety has from 1 to 3 carbon atoms) of unsaturated carboxylic acids such as acrylic acid, methacrylic acid, crotonic acid, itaconic acid or maleic acid; styrene derivatives such as styrene, vinyltoluene, chlorostyrene or α-methylstyrene; unsaturated carboxylic acids such as acrylic acid, methacrylic acid, crotonic acid, maleic acid or itaconic acid, or anhydrides or amides thereof; and polymerizable monomers having various polar groups such as a hydroxyl group, an amino group, an amido group, a cyano group, a sulfonic acid group, a carbonyl group, a halogen atom or a hetero-ring, for example, hydroxyethyl methacrylate, hydroxyethyl acrylate, methoxyethyl acrylate, ethoxyethyl acrylate, dimethylaminoethyl methacrylate, diethylaminoethyl methacrylate, trimethoxysilylpropyl methacrylate, N-vinylpyrrolidone, acrylonitrile, methacrylonitrile, 2-cyanoethyl methacrylate, 2-chloroethyl methacrylate, N-vinylpyridine, N-vinylimidazole or 2-furfurylethyl methacrylate.

The monofunctional macromonomer (B) is one composed of a polymer moiety having a repeating unit of the formula (I) and a double bond-containing group of the formula (II), which is copolymerizable with the monomer (A), as bonded to only one terminal of the main chain of the polymer moiety, and it has a number average molecular weight of $1\times10^4$ or less.

In the formulae (I) and (II), the hydrocarbon group for $a_1$, $a_2$, X, Y, $b_1$, $b_2$ and V have the number of carbon atoms as indicated (in the moiety of the unsubstituted hydrocarbon group), and the hydrocarbon group may optionally be substituted.

In formula (I), $R_1$ in the substituent X represents a hydrogen atom or a hydrocarbon group having from 1 to 18 carbon atoms. Preferred hydrocarbon groups for $R_1$ include an optionally substituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, 3-bromopropyl), an optionally substituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl), an optionally substituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl), an optionally substituted alicyclic group having from 5 to 8 carbon atoms (e.g., cyclohexyl, 2-cyclohexylethyl, 2-cyclopentylethyl), or an optionally substituted aromatic group (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, decyloylamidophenyl).

When X represents

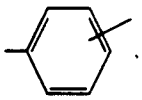

, the benzene ring may optionally have one or more substituents. Examples of the substituents include a halogen atom (e.g., chlorine, bromine) and an alkyl group (e.g., methyl, ethyl, propyl, butyl, chloromethyl, methoxymethyl).

Y preferably represents a hydrocarbon group having from 1 to 18 carbon atoms, which includes, for example, the embodiments as mentioned above for the group $R_1$.

$a_1$ and $a_2$ (which may be same or different) each preferably represents a hydrogen atom, a halogen atom (e.g., chlorine, bromine), a cyano group, an alkyl group having from 1 to 3 carbon atoms (e.g., methyl, ethyl, propyl), —COO—Z or —$CH_2$COOZ wherein Z represents a hydrogen atom or an alkyl, alkenyl, aralkyl, alicyclic or aryl group having from 1 to 18 carbon atoms, and the groups may optionally be substituted. Specifically, Z may have the same meaning as $R_1$ as defined above.

In formula (II), V has the same meaning as X in formula (I); and $b_1$ and $b_2$ (which may be the same or different) each is selected from the same groups as $a_1$ or $a_2$ in formula (I). For the preferred embodiments of the groups of V, $b_1$ and $b_2$, therefore, those mentioned above for the groups X, $a_1$ and $a_2$ apply.

More preferably, one of $a_1$ and $a_2$ in formula (I) or $b_1$ and $b_2$ in formula (II) is a hydrogen atom.

The macromonomers used in the present invention have a particular chemical structure in which the polymerizable double bond group as represented by the formula (II) is, directly or via any optional linking group, bonded to only one terminal of the main chain of the polymer comprising the repeating unit as represented by the formula (I). The group of linking the component of the formula (I) and the component of the formula (II), if any, may be composed of a combination of atomic groups of carbon-carbon bond (single bond or double bond), carbon-hetero atom bond (the hetero atom may be oxygen, sulfur, nitrogen or silicon) and/or hetero atom-hetero atom bond.

Preferred monomers of the macromonomers (B) for use in the present invention are those represented by the following formula (III)

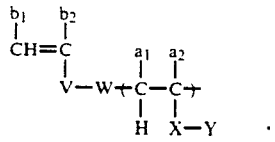

(III)

wherein $a_1$, $a_2$, $b_1$, $b_2$, X, Y and V have the same meanings as those in the formulae (I) and (II).

W represents a chemical bond or a single linking group selected from atomic groups of

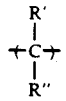

(wherein R′ and R″ each represents a hydrogen atom, a halogen atom (e.g., fluorine, chlorine, bromine), a cyano group or a hydroxyl group),

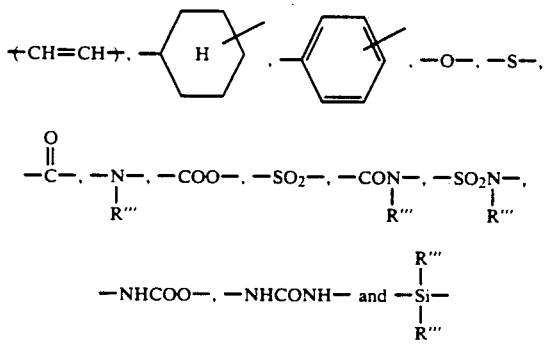

atom or a hydrocarbon group, selected from the same groups as the aforesaid $R_1$), or a composite linking group composed of a combination of the above-described single linking groups.

The macromonomers (B) for use in the present invention have a number average molecular weight of $1\times10^4$ or less. If the upper limit of the number average molecular weight of (B) exceeds $1\times10^4$, the printing durability of the liquid developer would lower. On the other hand, if the molecular weight thereof is too small, the liquid developer would cause stain. Accordingly, it is preferably $1\times10^3$ or more.

In the aforesaid formulae (I), (II), and (III), preferred embodiments of X, Y, V, $a_1$, $a_2$, $b_1$ and $b_2$ are further described below.

X is preferably —COO—, —OCO—, —O—, —$CH_2$COO— or —$CH_2$OCO—; Y is preferably an alkyl or alkenyl group having 18 or less carbon atoms; V may be any of the groups noted above (provided that $R_1$ is a hydrogen atom); and $a_1$, $a_2$, $b_1$, and $b_2$ each is preferably a hydrogen atom or a methyl group.

The macromonomers (B) for use in the present invention can be prepared by any conventional methods. For instance, an ion polymerization method may be used, wherein various reagents are reacted with the terminal of a living polymer obtainable by anion polymerization or cation polymerization to give a macromonomer, a radical polymerization method where a terminal reactive group-having oligomer obtainable by radical polymerization in the presence of a polymerization initiator and/or a chain transferring agent containing a carboxyl group, a hydroxyl group, an amino group, or the like reactive group, is further reacted with various reagents to give a macromonomer, and a polyaddition condensation method where a polymerizable double bond-containing group is introduced into an oligomer obtainable by polyaddition or polycondensation reaction, in the same manner as in the aforesaid radical polymerization method.

Specifically, the macro monomers (B) for use in the present invention can be prepared in accordance with the methods described in P. Dreyfuss & R.P. Quirk, *Encycl. Polym. Sci. Eng.*, Vol. 7, p. 551 (1987); P.F. Rempp & E. Franta, *Adu., Polym Sci.*, Vol. 58, p. 1 (1984); V. Percec, *Appl. Polym. Sci.*, Vol. 285, p. 95 (1984); R. Asami & M. Takagi, *Makvamol. Chem. Suppl.*, Vol. 12, p. 163 (1985); P. Rempp, et al., *Makvamol. Chem. Suppl.*, Vol. 8, p. 3 (1984); Y. Kawakami, *Chemical Industry*, Vol. 38, p. 56 (1987); Y. Yamashita, *Polymer*, Vol. 31, p. 988 (1982); S. Kobayashi, *Polymer*, Vol. 30, p. 625 (1981); T. Higashimura, *Journal of Japan Adhesive Association*, Vol. 18, p. 536 (1982); K. Itoh, *Polymer Processing*, vol. 35, p. 262 (1986); S. Tohki & T. Tsuda, *Functional Materials*, 1987, No. 10-5, and U.S. Pat. Nos. 3,842,050, 3,842,059 and 3,862,098, JP-A-62-277408 and JP-A-63-54413 as referred to in the above literature references.

Specific examples of the macromonomers (B) for use in the present invention are set forth below, which, however, are not intended to restrict the scope of the present invention.

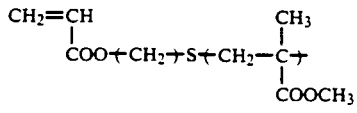

(1)

-continued
(2)
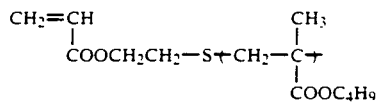
(3)
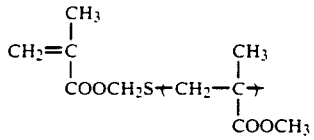
(4)
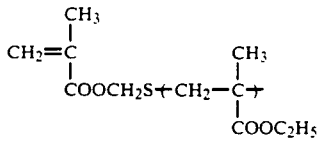
(5)
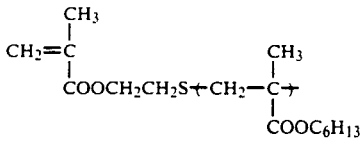
(6)
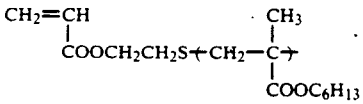
(7)
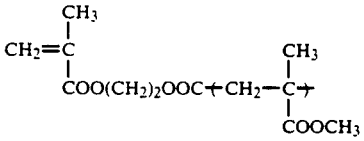
(8)
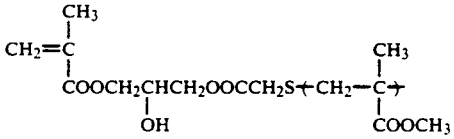
(9)
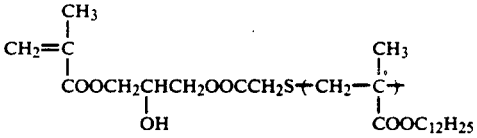
(10)
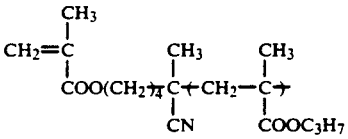
(11)
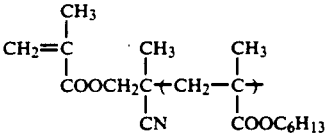
(12)
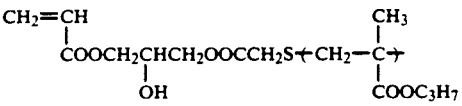
(13)
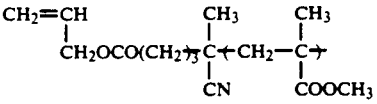

-continued
(14)
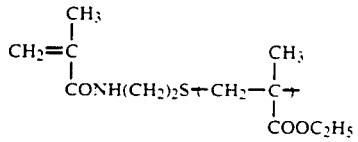
(15)
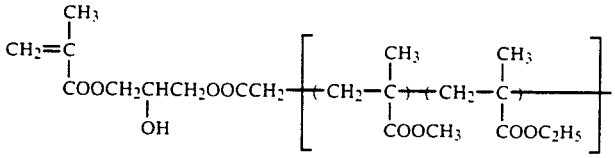
(16)
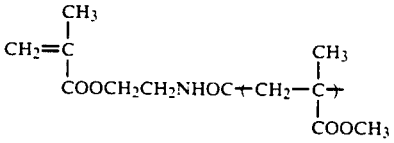
(17)
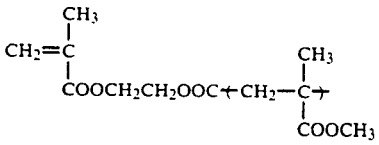
(18)
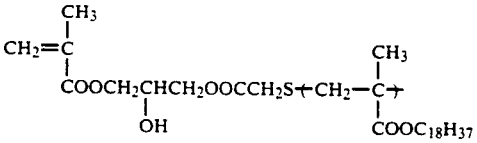
(19)
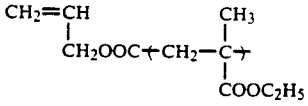
(20)
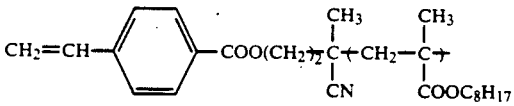
(21)
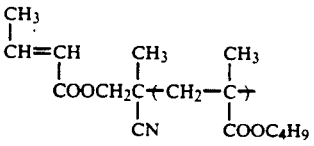
(22)
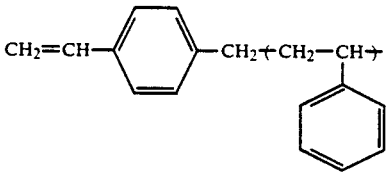
(23)
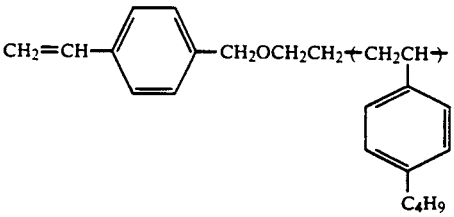

-continued
(24)
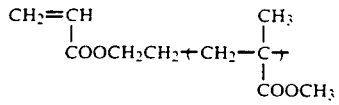
(25)
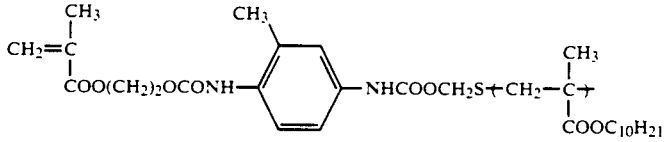
(26)
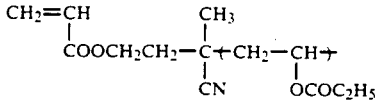
(27)
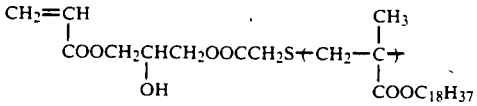
(28)
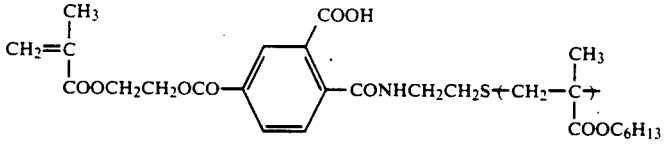
(29)
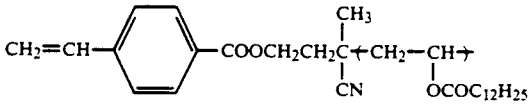
(30)
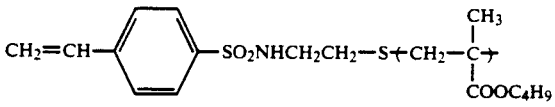
(31)
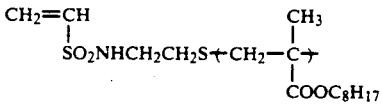
(32)
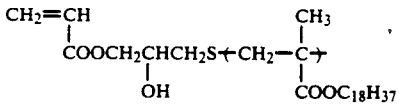
(33)
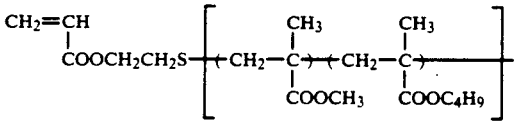
(34)
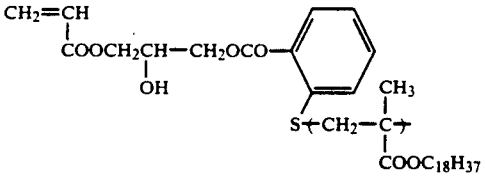
(35)
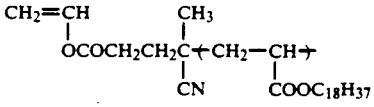
The dispersion resin to be contained in the liquid developer of the present invention is composed of at least one monomer (A) and at least one macromonomer (B), and the important aspect is that the resin produced from the above monomers is insoluble in the above-mentioned non-aqueous solvents, whereby the desired dispersion resin may be obtained. More specifically, the monomer (B) as represented by the formula (I) is used preferably in an amount of from 0.05 to 10% by weight, more preferably from 0.1 to 5% by weight, and most preferably from 0.3 to 3% by weight, of the monomer (A) to be insolubilized. The dispersion resin thus formed has a molecular weight of from $1\times10^3$ to $1\times10^6$, and preferably from $1\times10^4$ to $5\times10^5$.

In order to prepare the dispersion resin to be used in the present invention, in general, the aforesaid dispersion-stabilizing resin, the monomer (A) and the macromonomer (B) are polymerized under heat in a non-aqueous solvent in the presence of a polymerization initiator such as benzoyl peroxide, azobisisobutyronitrile or butyl lithium. Specifically, examples include: a method where a polymerization initiator is added to a mixture comprising the dispersion-stabilizing resin, the monomer (A) and the macromonomer (B); a method where the monomer (A) and the macromonomer (B) are dropwise added to a solution containing the dispersion-stabilizing resin, together with a polymerization initiator; a method where the total amount of the dispersion-stabilizing resin and a part of a mixture comprising the monomer (A) and the macromonomer (B) are blended and a polymerization initiator is added to the resulting blend together with the remaining monomer mixture of any desired amount; and a method where a mixture comprising the dispersion-stabilizing resin, the monomer (A) and the macromonomer (B) are added to a non-aqueous solvent together with a polymerization initiator in any desired manner. Any of these methods may be employed for preparing the dispersion resin of the present invention.

The total amount of the monomer (A) and the macromonomer (B) is from about 5 to about 80 parts by weight, preferably from 10 to 50 parts by weight, per 100 parts by weight of the non-aqueous solvent.

The amount of the dispersion-stabilizing resin, which is a soluble resin, is from about 1 to about 100 parts by weight, and preferably from 5 to 50 parts by weight, per 100 parts of the total amount of the monomers (A) and (B).

The amount of the polymerization initiator to be used is typically from about 0.1 to about 5% by weight of the total amount of the monomers used.

The polymerization temperature is generally from about 50° to about 180° C., and preferably from 60° to 120° C. The reaction time is preferably from about 1 to about 15 hours.

When the above-mentioned polar solvents, such as alcohols, ketones, ethers or esters, are used together with the non-aqueous solvent in the reaction, or when the non-reacted monomer (A) has remained after polymerizing granulation, the solvents or the non-reacted monomer (A) are preferably removed by evaporation while heating the reaction mixture to a temperature higher than the boiling point of the solvents or the monomer, or by distillation under reduced pressure.

The non-aqueous dispersion resin thus prepared in accordance with the present invention comprises fine resin grains having a uniform grain size distribution, and it displays an extremely stable dispersibility. In particular, even when the liquid developer of the invention containing the non-aqueous dispersion resin is used repeatedly for a long period of time in a development apparatus, the dispersibility of the resin in the developer is well maintained. In addition, even when the developing speed is elevated, the re-dispersion of the resin in the liquid developer is easy, so that the resin grains do not stick to the parts of the apparatus under such high load conditions.

After fixing under heat, a strong film may be formed, and the dispersion resin has been found to have an excellent fixability.

Moreover, even when the liquid developer of the present invention is used in the process of an accelerated development-fixation step of using a master plate of a large size, the dispersion stability, the redispersibility and the fixability are excellent.

The liquid developer of the present invention may contain a colorant, if desired.

The colorant is not specifically limited, but any conventional pigments or dyes can be used as the colorant.

When the dispersion resin itself is to be colored, for example, a pigment or dye is physically dispersed in the dispersion resin as one method. Various kinds of pigments and dyes are known, which can be used in the method. Examples include magnetic iron oxide power, lead iodide powder, carbon black, nigrosine, alkali blue, hansa yellow, quinacridone red, and phthalocyanine blue.

As another method of coloring the liquid developer, the dispersion resin may be dyed with a desired dye, for example, as disclosed in JP-A-57-48738. As still other methods, the dispersion resin may be chemically bonded to a dye, for example, as disclosed in JP-A-53-54029; or a previously dye-containing monomer is used in polymerizing granulation to obtain a dye-containing polymer, for example, as disclosed in JP-B-44-22955. (The term "JP-B" as used herein means an "examined Japanese patent publication".)

Various additives may be added to the liquid developer of the present invention so as to enhance the charging characteristic or to improve the image-forming characteristic. For example, the substances described in Y. Harasaki, *Electrophotography*, Vol. 16, No. 2, page 44 can be used for such purpose.

Specifically, useful additives include metal salts of 2-ethylhexylsulfosuccinic acid, metal salts of naphthenic acid, metal salts of higher fatty acids, lecithin, poly(vinylpyrrolidone) and copolymers containing half-maleic acid amide component.

The amounts of the main constituting components of the liquid developer of the present invention are further explained below.

The amount of the toner grains consisting essentially of a resin and a colorant is preferably from about 0.5 to about 50 parts by weight per 1000 parts by weight of the liquid carrier. If it is less than about 0.5 part by weight, the image density would be insufficient. However, if it is more than about 50 parts by weight, the non-image area would thereby be fogged. In addition, the above-mentioned liquid carrier-soluble resin for enhancing the dispersion stability may also be used, if desired, and it may be added in an amount of from about 0.5 part by weight to about 100 parts by weight, to 1000 parts by weight of the liquid carrier. The above-mentioned charge-adjusting agent is preferably used in an amount of from about 0.001 to about 1.0 part by weight per 1000 parts by weight of the liquid carrier. In addition, various additives may also be added to the liquid developer of the present invention, if desired, and the upper limit of the total amount of the additives is to be defined in accordance with the electric resistance of the liquid developer. Specifically, if the electric resistance of the liquid developer, from which to toner grains are removed, is lower than $10^9$ Ωcm, images with good continuous gradation could hardly be obtained. Accordingly, the amounts of the respective additives are required to be properly controlled within the said limitation.

The following examples are intended to illustrate the embodiments of the present invention in greater detail, but not to limit the present invention in any way.

PREPARATION OF MACROMONOMERS

Preparation Example 1

A mixture comprising 92 g of methyl methacrylate, 5 g of thioglycolic acid and 200 g of toluene was heated to 75° C. with stirring in nitrogen stream. 31 g of 2,2'-azobis(cyanovaleric acid) (ACV) was added thereto and the reaction was carried out for 8 hours. Next, 8 g of glycidyl methacrylate, 1.0 g of N,N-dimethyldodecylamine and 0.5 g of t-butylhydroquionone were added to the reaction mixture and stirred at 100° C. for 12 hours. After cooling, the reaction mixture was re-precipitated in 2 liters of methanol to give 82 g of a white powder. The polymer thus obtained had a number average molecular weight of 6,500.

Preparation Example 2

A mixture comprising 95 g of methyl methacrylate, 5 g of thioglycolic acid and 200 g of toluene was heated to 70° C. with stirring in nitrogen stream. 1.5 g of 2,2'-azobis(isobutyronitrile) (AIBN) was added thereto and the reaction was carried out for 8 hours. Next, 7.5 g of glycidyl methacrylate, 1.0 g of N,N-dimethyldodecylamine and 0.8 g of t-butylhydroquinone were added to the reaction mixture and stirred at 100° C. for 12 hours. After cooling, the reaction mixture was re-precipitated in 2 liters of methanol to give 85 g of a colorless transparent viscous material. The polymer thus obtained had a number average molecular weight of 2,400.

Preparation Example 3

A mixture comprising 94 g of methyl methacrylate, 6 g of 2-mercaptoethanol and 200 g of toluene was heated to 70° C. in nitrogen stream. 1.2 g of AIBN was added thereto, and the reaction was carried out for 8 hours. Next, the reaction mixture was cooled in a water bath to lower the temperature to 20° C. and 10.2 g of triethylamine was added thereto, and then 14.5 g of methacrylic acid chloride was dropwise added thereto at a temperature of 25° C. or lower with stirring. After dropwise addition, the whole was continued to be stirred for further one hour. Thereafter, 0.5 g of t-butylhydroquinone was added to the reaction mixture, which was then heated to 60° C. and stirred for 4 hours. After cooling, the resulting mixture was re-precipitated in 2 liters of methanol to give 79 g of a colorless transparent viscous material. The polymer thus obtained had a number average molecular weight of 4,500.

Preparation Example 4

A mixture comprising 95 g of hexyl methacrylate and 200 g of toluene was heated to 70° C. in nitrogen stream. 5 g of 2,2-azobis(cyanoheptanol) was added thereto, and the reaction was carried out for 8 hours.

After cooling, the reaction mixture was put in a water bath to adjust the temperature thereof to 20° C. 1.0 g of triethylamine and 21 g of methacrylic anhydride were added thereto, and the mixture was stirred for 1 hour at that temperature and then for 6 hours at 60° C.

The reaction product thus obtained was cooled and re-precipitated in 2 liters of methanol to give 75 g of a colorless transparent viscous material. The polymer thus obtained had a number average molecular weight of 6,200.

Preparation Example 5

A mixture comprising 93 g of dodecyl methacrylate, 7 g of 3-mercaptopropionic acid, 170 g of toluene and 30 g of isopropanol was heated to 70° C. in nitrogen stream to give a uniform solution. 2.0 g of AIBN was added thereto and the reaction was carried out for 8 hours. After cooling, the reaction mixture was re-precipitated in 2 liters of methanol and then heated at 50° C. under reduced pressure to evaporate the solvent therefrom. The viscous product thus obtained was dissolved in 200 g of toluene, and 16 g of glycidyl methacrylate, 1.0 g of N,N-dimethyldodecyl methacrylate and 1.0 g of 5-butylhydroquinone were added to the resulting mixture which was then stirred for 10 hours at 110° C. The reaction mixture was again re-precipitated in 2 liters of methanol. The pale yellow viscous material thus obtained had a number average molecular weight of 3,400.

Preparation Example 6

A mixture comprising 95 g of octadecyl methacrylate, 5 g of thioglycolic acid and 200 g of toluene was heated to 75° C. with stirring in nitrogen stream. 1.5 g of AIBN was added thereto and the reaction was carried out for 8 hours. Next, 13 g of glycidyl methaenylate, 1.0 g of N,N-dimethyldodecylamine and 1.0 g of 5-butylhydroquinone were added and the whole was stirred for 10 hours at 110° C. After cooling, the reaction mixture was reprecipitated in 2 liters of methanol to give 86 g of a white powder. The resultant product had a number average molecular weight of 2,300.

Preparation Example 7

A mixture comprising 40 g of methyl methacrylate, 54 g of ethyl methacrylate, 6 g of 2-mercaptoethylamine, 150 g of toluene and 50 g of tetrahydrofuran was heated to 75° C. with stirring in nitrogen stream. 2.0 g of AIBN was added thereto and the reaction was carried out for 8 hours. Next, the reaction mixture was put in a water bath to adjust the temperature thereof to 20° C. Then, 23 g of methacrylic anhydride was added dropwise thereto while controlling the temperature so as not to exceed 25° C., and then the whole was stirred for further 1 hour under the same condition 0.5 g of 2,2'-methylene-bis(6-t-butyl-p-cresol) was added thereto, and the mixture stirred for 3 hours at 40° C. After cooling, the reaction mixture was re-precipitated in 2 liters of methanol to give 83 g of a viscous product. The resultant product had a number average molecular weight of 2,200.

Preparation Example 8

A mixture comprising 95 g of methyl methacrylate and 200 g of toluene was heated to 75° C. in nitrogen stream. 5 g of ACV was added thereto and the reaction was carried out for 8 hours. Next, 15 g of glycidyl acrylate, 1.0 g of N,N-dimethyldodecylamine and 1.0 g of 2,2'-methylene-bis(6-t-butyl-p-cresol) were added thereto, and the mixture was stirred for 15 hours at 100° C. After cooling, the reaction mixture was reprecipitated in 2 liters of methanol to give 83 g of a transparent viscous product. The resultant product had a number average molecular weight of 3,600.

Preparation of Latex Grains

Preparation Example I

A mixture comprising 18 g of poly(octadecyl methacrylate), 100 g of vinyl acetate, 1.0 g of macromonomer prepared in the aforesaid Preparation Example 1 and 380 g of Isopar H was heated to 75° C. with stirring in nitrogen stream. 1.7 of AIBN was added and the reaction was carried out for 6 hours. 20 minutes after the addition of the initiator, the reaction mixture became cloudy white, and the reaction temperature rose to 88° C. Then, the temperature was elevated to 100° C and the reaction mixture was stirred for 2 hours to remove the non-reacted vinyl acetate. After cooling, the reaction mixture was sieved through a 200 mesh nylon cloth, and the white dispersion thus obtained was a latex having a polymerization degree of 90% and a mean grain size of 0.20 μm.

Preparation Example II

A mixture comprising 20 g of poly(dodecyl methacrylate), 100 g of vinyl acetate, 1.0 g of macromonomer prepared in the aforesaid Preparation Example 2 and 385 g of isododecane was heated to 75° C. with stirring in nitrogen atmosphere. 1.7 g of AIBN was added and the reaction was carried out for 6 hours. 40 minutes after the addition of the initiator, the uniform reaction solution became cloudy white, and the reaction temperature rose to 85° C. After cooling, the reaction mixture was sieved through a 200 mesh nylon cloth, and the white dispersion thus obtained was a latex having a polymerization degree of 88% and a mean grain size of 0.26 μm.

Preparation Example III

A mixture comprising 14 g of poly(stearyl methacrylate) and 200 g of Shellsol 71 was heated to 75° C. with stirring in nitrogen stream.

A mixture comprising 100 of vinyl acetate, 1.0 g of macromonomer prepared in Preparation Example 1, 180 g of Shellsol 71 and 1.7 g of AIBN was dropwise added to the previous mixture over a period of 2 hours, and the whole was then stirred for 4 hours under the same condition. After cooling, the reaction mixture was sieved through a 200 mesh nylon cloth, and the white dispersion thus obtained was a latex having a polymerization degree of 85% and a mean grain size of 0.18 μm.

Preparation Example IV

A mixture comprising 15 g of dodecyl methacrylate/acrylic acid copolymer (95/5, by weight), 100 g of vinyl acetate, 1.0 g of macromonomer prepared in Preparation Example 3 and 380 g of Isopar G was heated to 75° C. with stirring in nitrogen stream. 1.5 g of benzoyl peroxide was added and the reaction was carried out for 6 hours. 10 minutes after the addition of the initiator, the reaction mixture became white and cloudy and the reaction temperature rose to 90° C. Thereafter, the temperature was elevated to 100° C. and the reaction mixture was stirred for further one hour under the same condition to evaporate vinyl acetate therefrom. After cooling, the mixture was sieved through a 200 mesh nylon cloth, and the white dispersion thus obtained was a latex having a polymerization degree of 90% and a mean grain size of 0.25 μm.

Preparation Example V

A mixture comprising 16 g of octadecyl methacrylate/2-hydroxyethyl methacrylate copolymer (92/81, by weight), 100 g of vinyl acetate, 1.5 g of macromonomer prepared in Preparation Example 4 and 385 g of Isopar H was heated to 70° C. with stirring in nitrogen stream. 1.2 g of 2,2'-azobis(isovaleronitrile) (AIVN) was added and the reaction was carried out for 6 hours. Then the temperature was elevated to 100° C. and stirring was continued for further one hour under the same condition so that the remaining vinyl acetate was evaporated out. After cooling, the reaction mixture was sieved through a 200 mesh nylon cloth, and the white dispersion thus obtained was a latex having a polymerization degree of 85% and a mean grain size of 0.17 μm.

Preparation Example VI

A mixture comprising 18 g of dodecyl methacrylate/octyl methacrylate copolymer (70/30, by weight), 100 g of vinyl acetate, 1.2 g of macromonomer prepared in Example 5 and 380 g of isodecane was heated to 70° C. with stirring in nitrogen stream.

1.2 g of AIVN was added and the reaction was carried out for 6 hours. Then the temperature was elevated to 100° C. and stirring was continued for further one hour under the same condition so that the remaining vinyl acetate was evaporated out. After cooling, the reaction mixture was sieved through a 200 mesh nylon cloth, and the white dispersion thus obtained was a latex having a polymerization degree of 87% and a mean grain size of 0.24 μm.

Preparation Example VII

A mixture comprising 20 g of poly(octadecyl methacrylate), 100 g of vinyl acetate, 5 g of crotonic acid, 1.0 g of macromonomer prepared in Preparation Example 6 and 468 g of Isopar E was heated to 70° C. with stirring in nitrogen stream. 1.3 g of AIVN was added and the reaction was carried out for 6 hours. Then the reaction temperature was elevated to 100° C. and stirring was continued for further one hour under the same condition so that the remaining vinyl acetate was evaporated out. After cooling, the reaction mixture was sieved through a 200 mesh nylon cloth, and the white dispersion thus obtained was a latex having a polymerization degree of 85% and a mean grain size of 0.23 μm.

Preparation Example VIII

A mixture comprising 20 g of poly(dodecyl methacrylate), 100 g of vinyl acetate, 6.0 g of 4-pentenoic acid, 1.5 g of macromonomer prepared in Preparation Example 7 and 380 g of Isopar G was heated to 75° C. with stirring in nitrogen stream. 0.7 g of AIBN was added and the reaction was carried out for 4 hours. Then 0.5 g of AIBN was added and the reaction carried out for further 2 hours. After cooling, the reaction mixture was sieved through a 200 mesh nylon cloth, and the white dispersion thus obtained was a latex having a mean grain size of 0.24 μm.

Preparation Example IX

A mixture comprising 18 g of dodecyl methacrylate/2-hydroxyethyl methacrylate copolymer (8/2, by mol), 85 g of vinyl acetate, 15 g of N-vinyl pyrrolidone. 1.2 g of macromonomer prepared in Preparation Example 1 and 380 g of n-decane was heated to 75° C. with stirring in nitrogen stream. 1.7 g of AIBN was added and the reaction was carried out for 4 hours. Then 0.5 g of AIBN was added and the reaction was carried out for further 2 hours. After cooling, the reaction mixture was sieved through a 200 mesh nylon cloth, and the white dispersion thus obtained was a latex having a mean grain size of 0.20 μm.

Preparation Example X

A mixture comprising 20 g of poly(octadecyl methacrylate), 100 g of isopropyl methacrylate, 1.0 g of macromonomer prepared in Preparation Example 8 and 470 g of n-decane was heated to 70° C. with stirring in nitrogen stream. 1.0 g of AIBN was added and the reaction was carried out for 2 hours. Several minutes after the addition of the initiator, the reaction mixture became blueish white and cloudy and the reaction temperature rose to 90° C. After cooling, the reaction mixture was sieved through a 200 mesh nylon cloth so as to remove core grains therefrom. The white dispersion thus obtained was a latex having a mean grain size of 0.45 μm.

Preparation Example XI

A mixture comprising 25 g of poly(dodecyl methacrylate), 100 g of styrene, 1.2 g of macromonomer ((B)-1) prepared in Preparation Example 1 and 380 g of Isopar H was heated up to 50° C. with stirring in nitrogen stream. An n-butyl lithium hexane solution was added to the mixture in an amount of 1.0 g as the solid content of n-butyl lithium, and the reaction was carried out for 4 hours. After cooling, the reaction mixture was sieved through a 200 mesh nylon cloth, and the white dispersion thus obtained was a latex having a mean grain size of 0.32 μm.

Preparation Example XII (Comparative Example A)

The process of Preparation Example I was repeated, except that the macromonomer ((B)-1) prepared in Preparation Example 1 was not used, and a latex of a white dispersion having a polymerization degree of 85% and a mean grain size of 0.25 μm was obtained.

Preparation Example XIII (Comparative Example B)

The process of Preparation Example I was repeated, except that a mixture comprising 18 g of poly(octadecyl methacrylate), 100 g of vinyl acetate, 1.0 g of octadecyl methacrylate and 385 g of Isopar H was used.

The white dispersion thus obtained was a latex having a polymerization degree of 85% and a mean grain size of 0.22 μm.

Preparation Example XIV (Comparative Example C)

The process of Preparation Example I was repeated, except that a mixture comprising 18 g of poly(octadecyl methacrylate), 100 g of vinyl acetate, 1 g of Monomer (I) having the following chemical structure and 385 g of Isopar H was used. The white dispersion thus obtained was a latex having a polymerization degree of 86% and a mean grain size of 0.24 μm. Monomer (I):

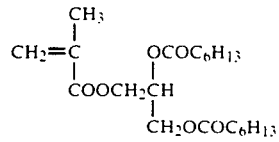

EXAMPLE 1

10 g of dodecyl methacrylate/acrylic acid copolymer (95/5, by weight), 10 g of nigrosine, and 30 g of Shellsol 71 were put in a paint shaker (manufactured by Tokyo Seiki Co.) together with glass beads, and dispersed for 4 hours, to obtain a fine nigrosine-containing dispersion.

30 g of the resin dispersion (latex grains) obtained in the aforesaid Preparation Example I, 2.5 g of the above prepared nigrosine dispersion and 0.08 g of octadecene/semimaleic acid octadecylamide copolymer were diluted in one liter of Shellsol 71 to obtain a liquid developer for electrostatic photography.

Preparation of Comparative Developers A to C

Three comparative developers A, B and C were prepared in the same manner as above, except that the resin grains mentioned below were used in place of the resin dispersion used above.

Comparative Liquid Developer A

Resin dispersion of latex grains prepared in Preparation Example XII was used.

Comparative Liquid Developer B

Resin dispersion of latex grains prepared in Preparation Example XIII was used.

Comparative Liquid Developer C

Resin dispersion of latex grains prepared in Preparation Example XIV was used.

The liquid developers thus prepared were used in a full-automatic processor ELP404V (manufactured by Fuji Photo Film Co., Ltd.), and ELP Mater II Type (electrophotographic light-sensitive material, produced by Fuji Photo Film Co., Ltd.) was exposed and developed therewith. The processing speed was 5 plates/minute. Then 2,000 plates of ELP Mater II Type were processed with each of the developers, whereupon the degree of the adhesion of ,the toner to the parts of the developing apparatus was checked. The determination of the density of the duplicated image (image area) was effected, using 30% original.

The results obtained were shown in Table 1 below.

TABLE 1

| Test No. | Developer Used | Stains of Developing Apparatus Used | 2000th Plate Image |
|---|---|---|---|
| 1 | Example | Good. No toner adhered. | Good. Image was sharp. Dm = 1.2 |
| 2 | Comparative Developer A | Extremely Bad. Noticeable toner residue adhered. | Extremely Bad. Letter parts lost. Background area was stained and fogged. Dm = 1.0 |
| 3 | Comparative Developer B | Bad. Some toner residue adhered. | Bad. Fine lines somewhat blurred. Dm = 0.8 |
| 4 | Comparative | Bad. | Bad. |

TABLE 1-continued

| Test No. | Developer Used | Stains of Developing Apparatus Used | 2000th Plate Image |
|---|---|---|---|
| | Developer C | Some toner residue adhered. | Fine lines somewhat blurred. Dm = less than 0.5 |

As is clear from the results in Table 1 above, the liquid developer of the present invention (No. 1) was superior to any other comparative liquid developers (Nos. 2 to 4). Specifically, the 2000the plate image was sharp only when processed with the liquid developer of the invention, and the parts of the developing apparatus was not stained only when the developer of the invention was used.

Next, the offset printing master plate (ELP-Master) prepared by processing with each of the above-mentioned developers was used for printing in a conventional manner. The number of prints obtained was counted, before the image in the print contained some failures that the letters were broken or the flat image area blurred. As a result, the master plate prepared with each of the developer of the invention or the comparative developer A or C, gave 10,000 or more prints with no failure, while the master plate prepared with the comparative developer B resulted in failure after 8,000 prints.

As is obvious from the above-mentioned results, only the developer of the present invention could advantageously be used for preparing a large number of master plates with no stain in the parts of the developing apparatus, and the number of prints obtainable from the master plate thus formed by the use of the developer of the invention with no failure was extremely large.

Specifically, when the comparative developer A was used, the parts of the developing apparatus used noticeably stained although the number of the prints obtainable with the master plate was sufficiently large. Accordingly, the comparative developer A is unsuitable for continuous use.

Regarding the other comparative developers B and C, when they were used under the condition of a rapid processing speed of 5 plates/minute (generally, the processing speed is from 2 to 3 plates/minute in conventional plate-making process), they stained the parts of the developing apparatus (especially on the back surface of the electrode plate). After formation of 2000 plates or so, the image quality of the duplicated image on the plate was adversely influenced by the stain of the developing apparatus with the developer (for example, lowering of Dm or blurring of fine lines in the duplicated image). In addition, the number of the prints obtainable by the use of the master plate was small in the case where the comparative developer B was used, although it was sufficiently large in the case where the comparative developer C was used. When the Dm value of the plate image is 0.9 or below, it produces practical problems in the evaluation of the plate image.

These results demonstrate that the resin grains in the liquid developer of the present invention was superior to those in anyone of the other comparative developers.

EXAMPLE 2

A mixture comprising 100 g of the white dispersion (latex grains) obtained in Preparation Example I and 1.5 g of Sumikalon Black was heated up to 100° C. and stirred for 4 hours under heat. After cooling to room temperature, the resulting mixture was sieved through a 200 mesh nylon cloth to remove the remaining dye. Thus a black resin dispersion having a mean grain size of 0.20 μm was obtained.

32 g of the thus prepared black resin dispersion and 0.05 g of zirconium naphthenate were diluted in one liter of Shellsol 71 to give a liquid developer.

This was applied to the same apparatus as that used in Example 1 for plate-making, and no toner adhered to the parts of the apparatus even after development of 2000 plates.

The image quality of the offset printing master plate thus prepared was sharp. When the master plate was used for printing, 10,000 or more prints were obtained, all of which had an extremely sharp image.

EXAMPLE 3

A mixture comprising 100 g of the white dispersion (latex grains) prepared in Preparation Example VII and 3 g of Victoria Blue was heated to 70° to 80° C. and stirred for 6 hours under heat. After cooling to room temperature, the resulting mixture was sieved through a 200 mesh nylon cloth to remove the remaining dye therefrom. Thus a blue resin dispersion having a mean grain size of 0.16 μm was obtained.

32 g of the thus prepared blue resin dispersion and 0.05 g of zirconium naphthenate were diluted in one liter of Isopar H to give a liquid developer.

This was applied to the same apparatus as that used in Example 1 for plate-making, and no toner adhered to the parts of the apparatus even after development of 2000 plates. The image quality of the offset printing plates thus obtained was sharp. When the master plate was used for printing, 10,000 or more prints were obtained, all of which had an extremely sharp image.

EXAMPLE 4

32 g of the white resin dispersion (latex grains) prepared in Preparation Example II, 2.5 g of the nigrosine dispersion obtained in Example 1 and 0.02 g of half-docosanylamidated product of diisobutylene/maleic anhydride copolymer were diluted in one liter of Isopar G to obtain a liquid developer.

This was applied to the same apparatus as that used in Example 1 for plate-making, and no toner adhered to the parts of the apparatus even after development of 2000 plates. The image quality of the offset printing plates thus obtained was sharp. When the master plate was used for printing, 10,000 or more prints were obtained, all of which had an extremely sharp image.

Then the developer was stored for 3 months and then subjected to the same process as above. As a result, the property of the developer thus stored was quite same as that of the developer before stored.

EXAMPLE 5

10 g of poly(decyl methacrylate), 30 g of Isopar H and 8 g of Alkali Blue were put in a paint shaker together with glass beads and dispersed for 2 hours to obtain a fine dispersion of Alkali Blue.

30 g of the white resin dispersion (latex grains) prepared in Preparation Example III, 4.2 g of the above prepared Alkali Blue-containing dispersion and 0.06 g of half-docosanylamidated product of diisobutylene/-maleic anhydride copolymer were diluted in one liter of Isopar G to prepare a liquid developer.

The resulting developer was applied to the same apparatus as that used in Example 1 for plate-making, and no toner adhered to the parts of the apparatus even after development of 2000 plates. The image quality of the offset printing plates thus obtained was sharp. When the master plate was used for printing, 10,000 or more prints were obtained, all of which had an extremely sharp image.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising a resin dispersed as grains in a non-aqueous solvent having an electrical resistance of $10^9$ Ωcm or more and a dielectric constant of 3.5 or less, wherein the dispersed resin grains are copolymer resin grains obtained by polymerizing a solution containing at least one monofunctional monomer (A) which is soluble in the non-aqueous solvent but becomes insoluble therein after polymerization and at least one monofunctional macromonomer (B) which is composed of a polymer moiety having a repeating unit of the following formula (I) and a copolymerizable double bond-containing group of the following formula (II) bonded to only one terminal of the main chain of the polymer moiety and which has a number average molecular weight of $1\times10^4$ or less, in the presence of a resin which is soluble in the non-aqueous solvent and which contains no graft group capable of polymerizing with the monomers;

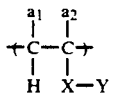
(I)

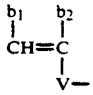
(II)

wherein in formula (I), X represents —COO—, —OCO—, —$CH_2$OCO—, —$CH_2$COO—, —O—, —$SO_2$—, —

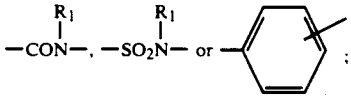

$R_1$ represents a hydrogen atom or a hydrocarbon group having from 1 to 18 carbon atoms;

Y represents a hydrocarbon group having from 1 to 22 carbon atoms;

$a_1$ and $a_2$ each represents a hydrogen atom, a halogen atom, a cyano group, a hydrocarbon group having from 1 to 8 carbon atoms, a group —COO—Z or a group —COO—Z as interrupted by a hydrocarbon group having from 1 to 8 carbon atoms; and Z represents a hydrocarbon group having from 1 to 18 carbon atoms;

in formula (II), V has the same meaning as X in the formula (I); and $b_1$ and $b_2$ each is selected from the same groups as $a_1$ or $a_2$ in formula (I).

2. A liquid developer as in claim 1, wherein the monomer (A) is selected from vinyl acetate, allyl acetate; methyl, ethyl or propyl esters of acrylic acid, methacrylic acid, crotonic acid, maleic acid or itaconic acid; styrene derivatives; unsaturated carboxylic acids; or acid anhydrides thereof; and monomers having polar groups of a hydoxyl group, an amino group, an amido group, a cyano group, a sulfonic acid group, a carbonyl group, a halogen atom or a hetero-ring.

3. A liquid developer as in claim 1, wherein the macromonomer (A) is selected from compounds of a formula (III)

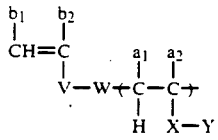
(III)

wherein $a_1$, $a_2$, $b_1$, $b_2$, X, Y and V have the same meanings as in the formulae (I) and (II) in claim 1; W represents a chemical bond or a single linking group selected from atomic groups of

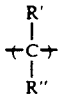

(wherein R′ and R″ each represents a hydrogen atom, a halogen atom a cyano group or a hydroxyl group)

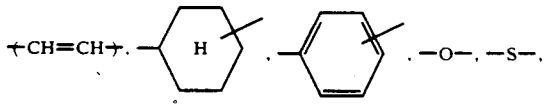

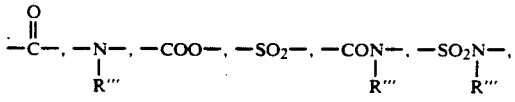

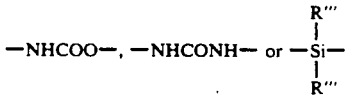

a hydrogen atom or a hydrocarbon group, selected from the same groups as the aforesaid $R_1$), or a composite linking group composed of a combination of the said single linking groups.

4. A liquid developer as in claim 1, wherein in formulae (I), (II) and (III), X represents —COO—, —OCO—, —O—, —$CH_2$COO— or —$CH_2$OCO—, Y represents an alkyl or alkenyl group having 18 or less carbon atoms, V represents —COO—, —OCO—, —$CH_2$OCO—, —$CH_2$COO—, —O—, —$SO_2$—,

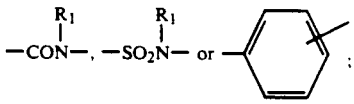

$R_1$ represents a hydrogen atom $a_1$, $a_2$, $b_1$ and $b_2$ each represents a hydrogen atom or a methyl group.

5. A liquid developer as in claim 3, wherein in formulae (I), (II) and (III), X represents —COO—, —OCO—, —O—, $CH_2COO$— or —$CH_2OCO$—, Y represents an alkyl or alkenyl group having 18 or less carbon atoms, V represents —COO—, —OCO—, —$CH_2OCO$—, —$CH_2COO$—, —O—, —$SO_2$—,

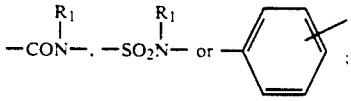

$R_1$ represents a hydrogen atom $a_1$, $a_2$, $b_1$ and $b_2$ each represents a hydrogen atom or a methyl group.

6. A liquid developer as in claim 2, wherein the monomer (A) is selected from vinyl acetate, allyl acetate; methyl, ethyl or propyl esters of acrylic acid, methacrylic acid, crotonic acid, maleic acid or itaconic acid; styrene derivatives such as unsubstituted styrene, vinyltoluene or α-methylstyrene; unsaturated carboxylic acids such as acrylic acid, methacrylic acid, crotonic acid, maleic acid, or itaconic acid, or acid anhydrides thereof; and monomers having polar groups of a hydoxyl group, an amino group, an amido group, a cyano group, a sulfonic acid group, a carbonyl group, a halogen atom or a hetero-ring such as hydroxyethyl methacrylate, hydroxyethyl acrylate, diethylaminoethyl methacrylate, N-binylpyrrolidone, acrylamide, acrylonitrile, 2-chloroethyl metharylate, or 2,2,2-trifluoroethyl methacrylate.

7. A liquid developer as in claim 1, wherein said macromonomer (B) has a umber average molecular weight of from $1\times10^3$ to $1\times10^4$.

8. A liquid developer as in claim 1, wherein said liquid developer further contains a colorant.

* * * * *